US008584969B2

(12) United States Patent
Drechsel

(10) Patent No.: US 8,584,969 B2
(45) Date of Patent: Nov. 19, 2013

(54) LIQUID DIFFUSER DEVICE

(76) Inventor: Arno Drechsel, Lienz (AT)

( * ) Notice: Subject to any disclaimer, the term of this patent is extended or adjusted under 35 U.S.C. 154(b) by 382 days.

(21) Appl. No.: 13/054,081

(22) PCT Filed: Jul. 24, 2009

(86) PCT No.: PCT/IB2009/053223

§ 371 (c)(1),
(2), (4) Date: Jul. 24, 2009

(87) PCT Pub. No.: WO2010/010535

PCT Pub. Date: Jan. 28, 2010

(65) Prior Publication Data

US 2011/0139896 A1 Jun. 16, 2011

(30) Foreign Application Priority Data

Jul. 24, 2008 (IT) ..... VI2008A0174

(51) Int. Cl.
*B05B 3/02* (2006.01)
*F23D 11/04* (2006.01)
*B05B 3/04* (2006.01)

(52) U.S. Cl.
USPC ..... 239/222.17; 239/222; 239/222.11; 239/222.21

(58) Field of Classification Search
USPC ..... 239/222, 222.11, 222.21, 214
See application file for complete search history.

(56) References Cited

U.S. PATENT DOCUMENTS

| | | | | |
|---|---|---|---|---|
| 4,660,766 | A * | 4/1987 | Nelson et al. | 239/222.17 |
| 5,224,653 | A * | 7/1993 | Nelson et al. | 239/222.17 |
| 5,377,914 | A * | 1/1995 | Christen | 239/252 |
| 5,439,174 | A * | 8/1995 | Sweet | 239/222.17 |
| 5,588,595 | A * | 12/1996 | Sweet et al. | 239/222.17 |
| 5,671,885 | A * | 9/1997 | Davisson | 239/222.17 |
| 5,718,381 | A | 2/1998 | Katzer | |
| 6,360,965 | B1 * | 3/2002 | Clearman et al. | 239/222.19 |
| 6,883,727 | B2 * | 4/2005 | De Los Santos | 239/240 |
| 6,899,287 | B2 * | 5/2005 | Pinch et al. | 239/380 |
| 7,395,977 | B2 * | 7/2008 | Pinch et al. | 239/222.21 |
| 7,942,345 | B2 * | 5/2011 | Sesser et al. | 239/222.21 |
| 2003/0085303 | A1 * | 5/2003 | Jaeger | 239/380 |
| 2006/0108445 | A1 | 5/2006 | Pinch | |
| 2008/0257982 | A1 * | 10/2008 | Kah et al. | 239/222.11 |
| 2011/0031332 | A1 * | 2/2011 | Sesser et al. | 239/222.17 |

FOREIGN PATENT DOCUMENTS

| | | |
|---|---|---|
| EP | 1426112 | 6/2004 |
| WO | 9722414 | 6/1997 |

* cited by examiner

*Primary Examiner* — Len Tran
*Assistant Examiner* — Alexander M Valvis
(74) *Attorney, Agent, or Firm* — Themis Law

(57) ABSTRACT

A liquid diffuser device comprises a support frame (2) with an upper tubular passageway (3) and a lower hollow body (4) defining a first longitudinal axis (L), a nozzle (5) associated with the passageway for directing a liquid jet longitudinally downwards at predetermined pressure and flow rate, a deflecting member (6) with a stem (7) held within the hollow body (4) and a deflecting plate (8) associated with the stem (7) and facing towards the nozzle (5) for deflecting the jet peripherally outwards and promoting the rotation ($\omega_1$) of the stem (7) about the first longitudinal axis (L) with a predetermined rotation speed, self-adjustment means (9) for adjusting the rotation speed of the stem, which comprise at least one elastomeric braking member (10) interposed between the stem (7) and the hollow body (4) for automatically adjusting the rotation speed of the stem (7) upon variation of pressure and flow rate of the liquid jet and for allowing even distribution of the diverted liquid.

10 Claims, 4 Drawing Sheets

LIQUID DIFFUSER DEVICE

FIELD OF THE INVENTION

The present invention generally finds application in the field of irrigation systems for agricultural and industrial applications, and particularly relates to a liquid diffuser device.

The device will be particularly suitable for irrigation of cultivated lands and may be used alone or in combination with one or more similar devices.

BACKGROUND ART

Liquid diffuser liquids, particularly of the type commonly known as "sprinklers" are known to be used in irrigation systems for distributing water or other fluids, particularly for large lands.

Typically, diffuser devices have a support frame which is designed to be connected to the hydraulic system and has a nozzle for directing the liquid jet to a specially shaped diffusion plate.

The latter is in turn mounted to a rotating stem, which is connected to the stationary part of the frame and is rotated under jet pressure.

A commonly recognized drawback of prior art devices is the difficulty of controlling the rotation speed of the plate to obtain as wide and uniform a jet as possible.

Furthermore, in these devices, a considerable part of the peripherally projected liquid is atomized due to the diffuser motion and evaporates before reaching the soil. Evaporation loss may even reach 30% in particularly dry environments.

In an attempt to overcome these drawbacks, various liquid diffuser solutions have been developed, which address some of these problems.

U.S. Pat. No. 5,439,174 discloses a diffuser device having a rotary deflecting member held within a hollow body and supported thereby via a universal joint.

The rotating member is driven into rotation by a gear assembly composed of a pair of facing gears integral with the rotating element and the hollow body respectively.

While this solution ensures rotation of the diffuser at any speed, it cannot control and limit the rotation speed of the rotating member and hence instantly adjust the water jet.

Furthermore, the presence of a gear assembly increases construction and assembly complexity and costs.

Also, since the hollow body is totally open, foreign bodies, such as sand or dust, may infiltrate the areas that support and contact the rotating member, and cause irregular operation, possibly leading to total blockage.

U.S. Pat. No. 5,588,595 also discloses a diffuser device in which the joint for connecting the rotating element with the fixed containing element is a ball bearing assembly.

While this prior art solutions provides a simpler diffuser, it still cannot adjust the rotation speed and cannot prevent abnormal operation and blockage from occurring as a result of foreign bodies penetrating the areas that support the mutually contacting parts or against which they slide.

DISCLOSURE OF THE INVENTION

The main object of the present invention is to obviate the above drawbacks, by providing a diffuser device that allows optimized control of the diffuser plate rotation in the various operating conditions, and can also adjust the position of the sprinkling surface relative to the water jet.

Another object of the present invention is to provide a diffuser device that can provide a wider and more uniform jet than prior art diffusers.

A further object is to provide a diffuser device that reduces liquid atomization for increased efficiency.

Yet another object is to provide a diffuser device that can withstand particularly dusty and contaminating environments and have a regular operation therein.

Another important object of the invention is to provide a diffuser device that has a relatively simplified construction, ensuring reliability and relatively low costs.

These and other objects as better explained hereafter are fulfilled by a liquid diffuser device as defined in claim 1, which comprises a support frame connectable to a liquid feeding pipe, said frame having an upper tubular passageway for the liquid and a lower hollow body both defining a first longitudinal axis, a nozzle associated with said upper passageway for directing a liquid jet longitudinally downwards at predetermined pressure, a deflecting member associated with said lower hollow body.

The deflecting member has a lower stem held within said lower tubular portion and an upper deflecting plate associated with said stem and facing towards said nozzle for deflecting the jet peripherally outwards and promoting the rotation of said stem about said first longitudinal axis with a predetermined rotation speed.

Self-adjustment means are further provided, for adjusting the rotation speed of said stem.

The device is characterized in that the self-adjustment means comprise at least one elastomeric braking member interposed between said stem and said lower hollow body for automatically adjusting the rotation speed of said stem in response to an increasing pressure of the jet generated by said nozzle and for providing an even distribution of the diverted liquid.

With this configuration, the device will adapt the rotation speed of the deflecting plate to the speed imposed by the liquid jet.

Advantageously, the braking member may have a substantially annular shape, with a side surface allowing relative sliding of the plate or step and the lower hollow body of the frame.

This will avoid the use of complex self-adjustment means, such as gears, and will afford a wider rotation of the plate, resulting in a longer jet, with actually no atomization effect.

BRIEF DESCRIPTION OF THE DRAWINGS

Further characteristics and advantages of the invention will become more apparent upon reading the following detailed description of a few preferred non exclusive embodiments of a liquid diffuser device of invention, which are described by way of a non limiting example with the help of the accompanying drawings in which.

DETAILED DESCRIPTION OF A PREFERRED EMBODIMENT

Figure 1:
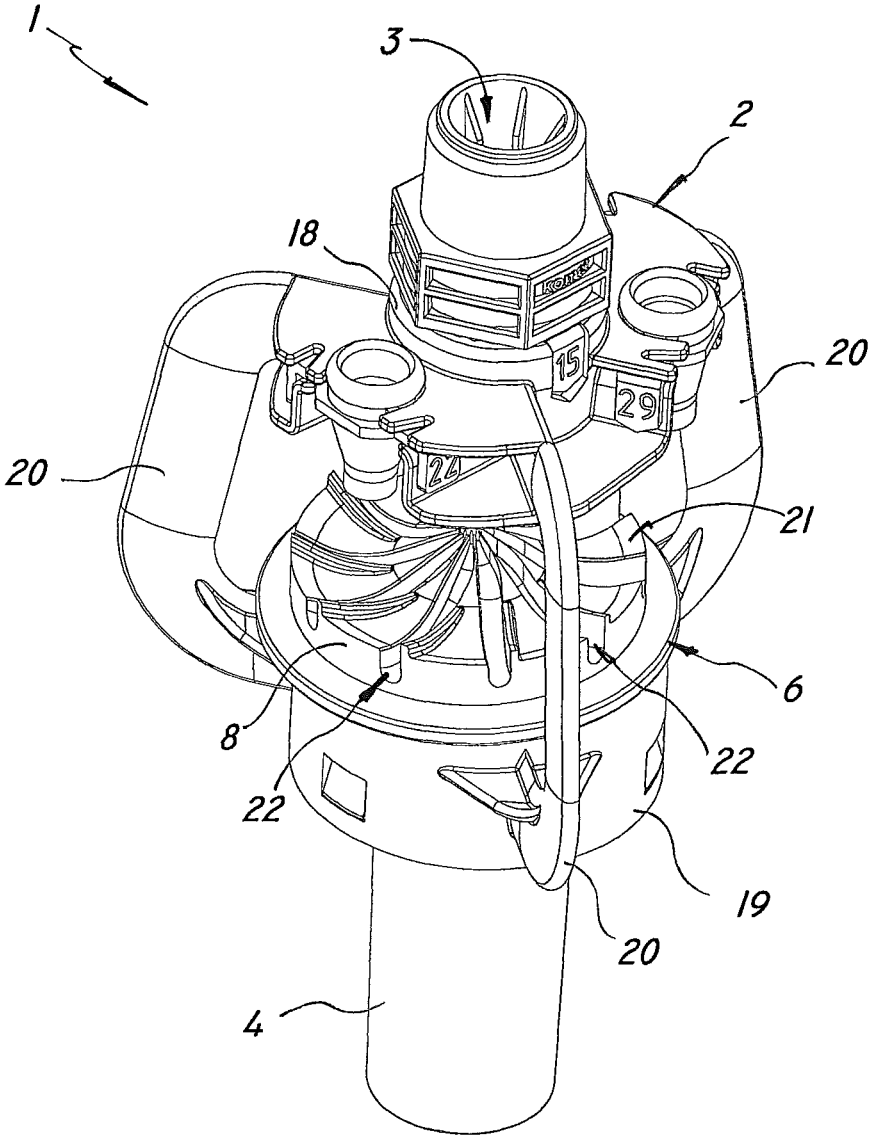
FIG. 1 is a perspective view of a liquid diffuser device of the invention.

Referring to the above figures, the diffuser device of the invention, generally designated by numeral 1, may be used to distribute a liquid, e.g. water, over surfaces, possibly having a very large surface area, such as in the irrigation of agricultural areas.

For this purpose, the device 1 may be connected to a hydraulic system, not shown, for liquid delivery and may be mounted, alone or in combination with other similar devices, to a stationary or rotating support arm, also not shown, to be set at a predetermined height, according to the desired jet length.

According to the invention, a liquid diffuser device comprises a support frame 2 connectable to a liquid feeding pipe of an irrigation system and having an upper tubular passageway 3 and a lower hollow body 4 both defining a first longitudinal axis L.

The upper passageway 3 of the frame 2 is associated with a nozzle 5 for directing a liquid jet longitudinally downwards at predetermined pressure and flow rate, and may extend in a substantially axial direction.

The lower hollow body 4 is associated with a deflecting member 6 having a substantially elongate lower stem 7, which defines a second longitudinal axis X and is held within the hollow body 4, and an upper deflecting plate 8 integral with the stem 7 and facing towards the nozzle 5 for deflecting the jet peripherally outwards and promoting the rotation ω1 of the stem 7 about the first longitudinal axis L at a predetermined rotation speed.

Self-adjustment means 9 are further provided, for adjusting the rotation speed of the stem 7.

According to a peculiar characteristic of the invention, the self-adjustment means 9 comprise at least one elastomeric braking member 10 interposed between the stem 7 and the lower hollow body 4 for automatically adjusting the rotation speed of the stem 7 in response to a variation of pressure and flow rate of the jet generated by the nozzle 5, for providing an even distribution of the diverted liquid.

Figures 2, 3:
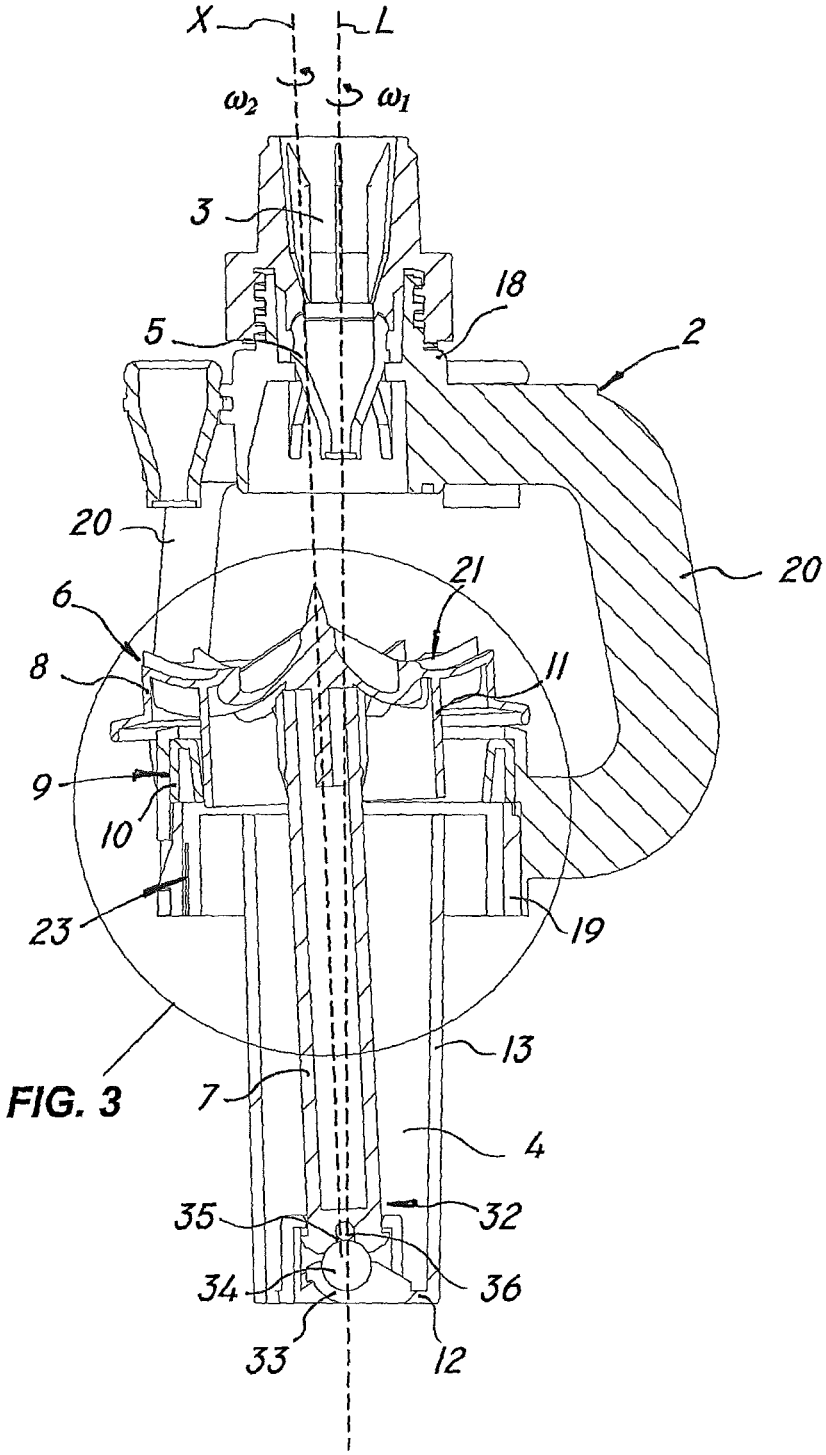
FIG. 2 is a cross sectional view of the device of FIG. 1, showing a first preferred configuration.
FIG. 3 is an enlarged view of a detail of FIG. 2.
Figure 3:
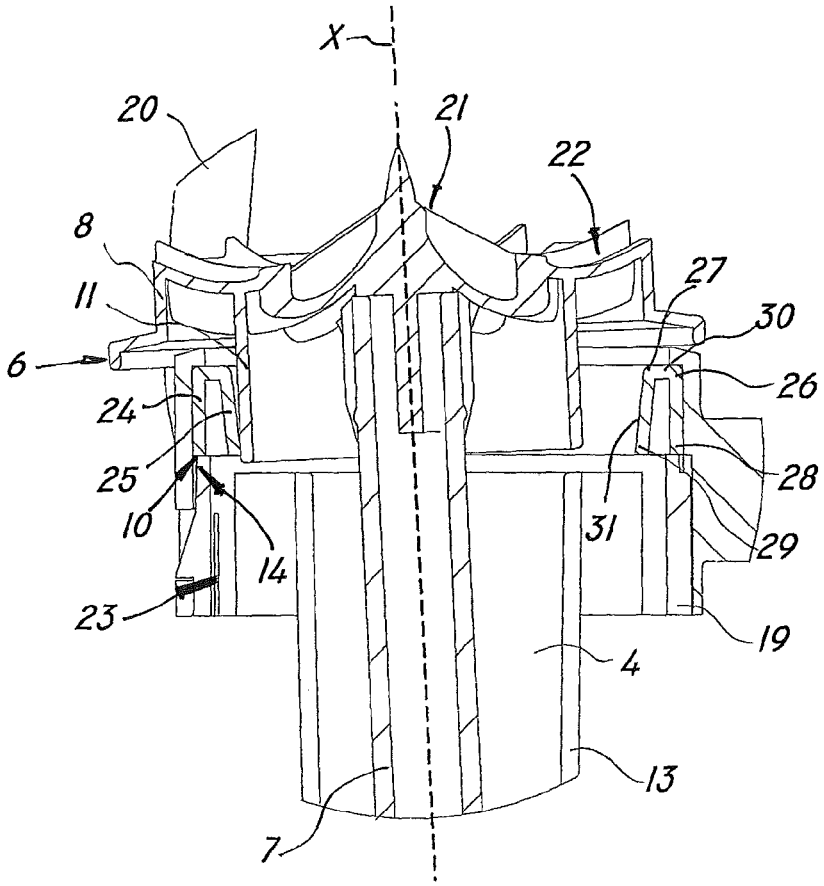

In the first configuration, as shown in FIGS. 1 to 3, the deflecting plate 8 may have a lower tubular portion 11 coaxial with the stem 7 and at least partially housed in the hollow body 4 and interposed between the latter and the stem 7.

In this case, the braking member 10 may be located in a position interposed between the lower tubular portion 11 of the plate 8 and the hollow body 4.

The latter may have a substantially transverse bottom wall 12 and a substantially cylindrical side wall 13 delimiting a rolling track 14 for the tubular portion 11 of the plate 8, or the stem 7.

The cylindrical shape of the hollow body 4 and the tubular portion 11 of the plate 8, having no undercut, prevents any impurity build up, which might cause irregularities in the complex rotational motion of the deflecting member 6.

The upper passageway 3 and the hollow body 4 may be joined together via a pair of upper 18 and lower 19 collars, which are in turn joined together by a plurality of arms 20.

The upper tubular passageway 3 and the upper collar 18 may be removably coupled for simplified removal and replacement of the nozzle 5.

The deflecting nozzle 8 may be attached to or be formed of one piece with the stem 7 and may be shaped as known.

Its upper surface 21 may be shaped with a plurality of radial diffusing channels 22 which are designed to impart an asymmetric shape to the plate 8, with angular sectors having different inclinations relative to the liquid jet projected by the nozzle 5, thereby transferring a torque to the stem 7, to cause a rotation ω1 during the initial transient.

In a particular advantageous aspect of the invention, the braking member 10 may have a substantially annular shape and be made from an elastomeric material, such as natural or synthetic rubber, having a relatively high friction coefficient.

Its longitudinal dimension may be selected as covering the whole contact portion between the tubular portion 11 of the plate 8 and the hollow body 4, or between the stem 7 and the hollow body 4.

Furthermore, the annular member 10 may be held in the hollow body 4 at the upper longitudinal end 23 to define a relative sliding surface between the tubular portion 11 of the plate and the side wall 13 of the hollow body 4.

According to a first embodiment of the invention, as shown in FIGS. 1 to 3, the annular braking member 10 may have a substantially cylindrical fixed wall 24 and a substantially frustoconical movable wall 25 coaxial with the fixed wall 24.

The annular member 10 may be designed as a lip seal with the two walls 24, 25 joined together at their upper edges 26, 27, whereas the lower edges 28, 29 may be radially offset from each other.

Particularly, the fixed wall 24 may contact with side wall 13 of the hollow body 4, whereas the movable wall 25 may face towards the tubular portion 11 of the plate 8.

Furthermore, the two annular walls 24, 25 may form one piece and be joined at their upper edges 26, 27 by a substantially radial ring 30 to define a substantially U-shaped axial section.

Thus, the tubular portion 11 of the plate 8, during its rotary motion ω1 about the first longitudinal axis L, may contact the movable wall 25 and cause its radial deformation with a deflection directly proportional to the thrust of said jet.

However, it shall be understood that the two walls 24, 25 of the braking member 10 may have reverse positions as compared with those in the figures, with the stationary wall 24 mounted to the tubular portion 11 of the plate 8, at the periphery thereof, and the movable wall 25 facing towards the side wall 13 of the hollow body 4, and still the same speed regulating effect as described above is obtained.

Figure 5:
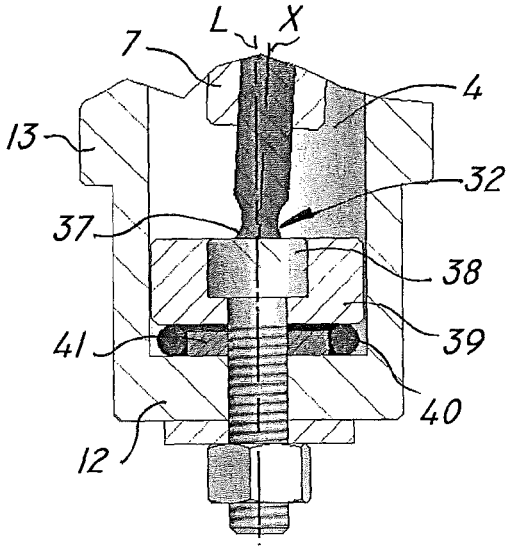
FIG. 5 is an enlarged view of a detail of the device of FIG. 4.
Figures 4, 5:
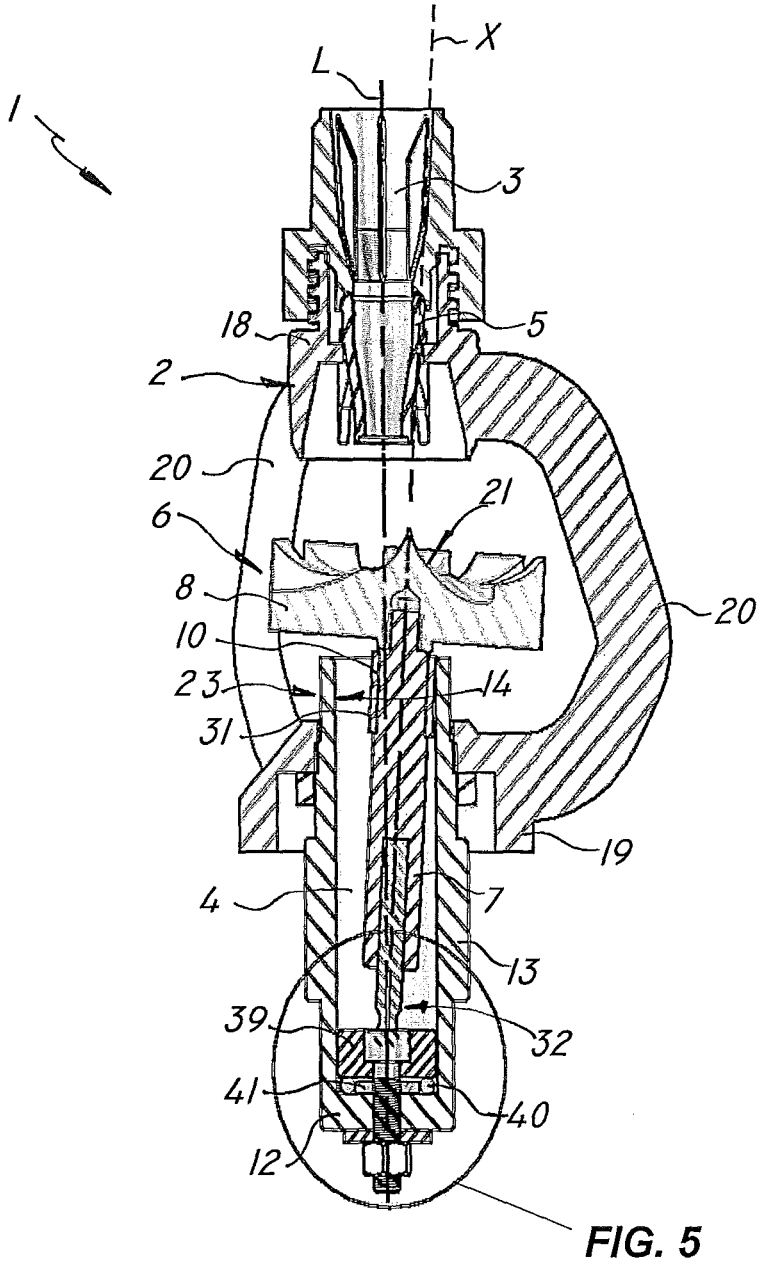
FIG. 4 is a cross-sectional side view of a diffuser device of the invention, showing a second preferred embodiment.

In the configuration as shown in FIG. 4, the annular braking member 10 may be a simple ring with a single relatively thin wall, mounted to the stem 7 coaxially therewith.

In this case, the outer surface 31 of the annular member 10 will define the rolling surface of the stem 7, whereas the side wall 13 of the hollow body 4 will define the rolling track.

In both cases, the axial dimension of the braking element 10 and its position along the first axis L or the second axis X may be other than those described above, without limitation to the scope of the present invention.

As shown in the figures, in both configurations the stem 7 may have a substantially cylindrical shape, with the second longitudinal axis X also defining its axis of symmetry.

Also, the stem 7 may have its lower end 32 hinged to the bottom wall 12 of the hollow body 4, to turn the rotary motion ω1 of the second axis X about the first longitudinal axis L into a precessional motion L and further allow rotation ω2 of the stem 7, and hence the plate 8, about the second axis X.

In a first embodiment, the lower end 32 of the stem 7 may be formed with a convex shape to rotate on a concave portion 33 of the bottom wall 12, possibly with a first ball 34 interposed therebetween.

In the latter case, a hollow housing may be formed in the lower end 32 of the stem 7, to receive a second ball 36 of smaller size than the first ball 34 and having the purpose of preventing the stem 7 from translating downwards due to the wear caused by contact of the convex surface 32 or the first ball 34.

In an alternative embodiment of the invention, as more clearly shown in FIG. 5, the hinged end 32 of the stem 7 may have a shaped outer surface 37 housed in a counter-shaped seat 38 of the bottom wall 12 of the hollow body 4.

Both the shaped end 37 of the stem 7 and the counter-shaped seat 38 of the bottom wall 12 may have a polygonal, e.g. hexagonal plan shape, and may be mounted with the polygon formed by the shaped end 37 of the stem 7 angularly offset from the polygon defined by its housing seat 38, to avoid coincidence of their respective vertices.

Therefore, during the rotation or precession ω1 of the stem 7, interferences will occur between the hinged end 32 and its housing seat 38, which will further decrease the speed of motion of the stem 7 and increase the jet length.

The bottom wall 12 may have a portion 39 axially sliding in the hollow body 4 to adjust the distance along the first longitudinal axis L between the deflecting plate 8 and the nozzle 5.

The provision of suitable sealing means 40, such as one or more gaskets, will ensure hermetic seal in the device, and protect it from any foreign matter intrusion.

Furthermore, a friction disk 41 may be interposed between the stationary bottom wall 12 and its sliding portion 39, which will utilize the axial thrust generated by the jet on the plate 8 and transferred therefrom to the stem 7 to exert a further speed regulating effect.

The particular configuration of the hinged end 32, of either convex or polygonal shape, will cause the longitudinal axis X to be inclined, in its rest position, to the first axis L, to promote the rotation $\omega_1$ of the stem 7 in the initial transient step.

In operation, the thrust exerted by the liquid jet delivered by the nozzle 5 on the plate 8 will cause the complex rotary or precessional motion ω1 of the second longitudinal axis X and the rotation $\omega_2$ of the stem 7, and hence the plate 8 integral therewith, so that the tubular portion 11 of the plate 8 or the stem 7 contact the cylindrical side wall 13 of the hollow body 4.

Due to the presence of the self-adjustment means 9, the precessional motion ω1 of the stem 7 will stabilize, after an irregular initial transient step in which it is substantially irregular, and will acquire a regular, reduced speed.

Such reduced speed will be caused by the combined motion of the stem 7 which is further facilitated by the friction between the tubular portion 11 of the deflecting plate 8 on the braking member 10 and will provide increased outward length of the liquid jet.

Furthermore, due to the inherent elasticity of the braking member 10, as jet pressure from the nozzle 5 increases, the plate 8 or stem 7 will exert a stronger squeezing force on the braking member 10.

This will also result in a larger contact surface between the plate 8 and the braking member 10, in the first illustrated configuration, or between the braking member 10 and the side wall 13 of the hollow body 4, in the second illustrated configuration.

In any case, friction will increase between the tubular portion 11 of the plate 8 and the braking member 10, or between the stem 7 and the hollow body 4, which will impart a regular behavior to the whole device 1 and will afford self-adjustment of the rotation speed of the deflecting member 6.

The particular size of the stem 7 relative to the hollow body 4, as more clearly shown in FIG. 2 and FIG. 4, will further increase the amplitude of the precessional oscillations ω1 of the stem 7 about the first axis L, thereby reducing the diffused liquid flow per unit area, and making it more uniform and consistent with time.

This will eliminate or at least considerably reduce the atomization effect that typically occurs in prior art diffusers, thereby providing a more efficient device.

The above disclosure clearly shows that the invention fulfills the intended objects and particularly meets the requirement of providing a liquid diffuser device that provides as wide and uniform a liquid jet as possible, while minimizing the amount of atomized liquid.

By its particular configuration, the device will be able to withstand particularly dusty and contaminating environments and have a regular operation therein.

The device of the invention is susceptible to a number of changes and variants, within the inventive concept disclosed in the appended claims. All the details thereof may be replaced by other technically equivalent parts, and the materials may vary depending on different needs, without departure from the scope of the invention.

While the device has been described with particular reference to the accompanying figures, the numerals referred to in the disclosure and claims are only used for the sake of a better intelligibility of the invention and shall not be intended to limit the claimed scope in any manner.

What is claimed is:

1. A liquid diffuser device, comprising:

a support frame connectable to a liquid feeding pipe, said support frame having an upper tubular passageway for a liquid and a lower hollow body both defining a first longitudinal axis;

a nozzle associated to said upper passageway of said support frame for directing longitudinally downwardly a liquid jet having predetermined pressure and flow rate;

a deflecting member with a lower stem defining a second longitudinal axis, said stem being fastened to said hollow body to allow rotation of said second longitudinal axis about said first longitudinal axis;

an upper deflecting plate associated to said stem and faced to said nozzle for deflecting peripherally outwardly the liquid and promoting the rotation of said longitudinal second axis about said first longitudinal axis and the rotation of said stem about said second longitudinal axis with respective predetermined rotation speeds; and self-adjustment means for adjusting the rotation speed of said stem and of said second axis;

wherein said self-adjustment means comprise at least one elastomeric braking member interposed between at least an upper portion of said stem and said hollow body for automatically adjusting the rotation speeds of said stem and of said second longitudinal axis upon variation of pressure and flow rate of the liquid jet and for providing an even distribution of the deflected liquid wherein said deflecting plate has a lower tubular portion extending therefrom and surrounding said stem, said lower portion being at least partially housed into said hollow body.

2. The device as claimed in claim 1, wherein said at least one braking member being interposed between said lower tubular portion and said hollow body.

3. The device as claimed in claim 2, wherein said hollow body has a substantially transverse bottom wall and a substantially cylindrical side wall providing a rolling track for said tubular portion of said plate.

4. The device as claimed in claim 3, wherein said at least one braking member is substantially annular with a side surface for relative sliding of said tubular portion of said plate with respect to said side wall of said hollow body.

5. The device as claimed in claim 4, wherein said at least one braking member has a substantially cylindrical fixed wall and a substantially frustoconical movable wall coaxial with said fixed wall.

6. The device as claimed in claim 5, wherein said fixed and movable walls are joined at their respective upper edges and have radially offset lower edges to allow, upon rotation of said stem, said movable wall to deform in a radial direction with a deflection directly proportional to a thrust of said liquid jet.

7. The device as claimed in claim 5, wherein said fixed wall of said at least one braking member is associated to said side wall of said hollow body, said movable wall being faced to said tubular portion of said plate.

8. The device as claimed in claim 4, wherein said at least one braking member is mounted onto said stem coaxially therewith.

9. The device as claimed in claim 4, wherein said stem is substantially cylindrical with a lower end hinged on said bottom wall of said hollow body to allow said second longitudinal axis to rotate about said first longitudinal axis.

10. The device as claimed in claim 9, wherein said hinged lower end of said stem has a shaped external surface housed into a counter-shaped seat of said bottom wall of said hollow body.

* * * * *